US007556713B2

(12) United States Patent
Stromberg

(10) Patent No.: US 7,556,713 B2
(45) Date of Patent: Jul. 7, 2009

(54) METHOD AND SYSTEM FOR FEEDING CELLULOSE CHIPS TO A HIGH PRESSURE CONTINUOUS COOKING SYSTEM

(75) Inventor: C. Bertil Stromberg, Bolton Landing, NY (US)

(73) Assignee: Andritz, Inc., Glens Falls, NY (US)

( * ) Notice: Subject to any disclaimer, the term of this patent is extended or adjusted under 35 U.S.C. 154(b) by 769 days.

(21) Appl. No.: 11/124,389

(22) Filed: May 9, 2005

(65) Prior Publication Data

US 2005/0279468 A1 Dec. 22, 2005

Related U.S. Application Data

(60) Provisional application No. 60/581,382, filed on Jun. 22, 2004.

(51) Int. Cl.
*D21C 5/00* (2006.01)

(52) U.S. Cl. ..... 162/52; 162/51; 162/246; 162/248

(58) Field of Classification Search ..... 162/52, 162/246, 248, 41
See application file for complete search history.

(56) References Cited

U.S. PATENT DOCUMENTS 5,476,572 A 12/1995 Prough
5,622,598 A 4/1997 Prough
5,635,025 A 6/1997 Bilodeau
5,753,075 A 5/1998 Stromberg et al.
5,766,418 A 6/1998 Prough
6,106,668 A 8/2000 Stromberg et al.
6,120,646 A 9/2000 Snekkenes et al.
6,325,890 B1 12/2001 Prough et al.
6,551,462 B2 4/2003 Prough et al.
6,669,410 B2 12/2003 Prough
2002/0060024 A1 * 5/2002 Prough et al. ..... 162/246

FOREIGN PATENT DOCUMENTS

WO WO 03/078727 A1 * 9/2003

OTHER PUBLICATIONS

Pulp and Paper Manufacture Third Edition, vol. 5, 1989, Joint Textbook Committee of the Paper Industry,p. 152-165.*

* cited by examiner

*Primary Examiner*—Eric Hug
*Assistant Examiner*—Jacob Thomas Minskey
(74) *Attorney, Agent, or Firm*—Nixon & Vanderhye P.C.

(57) ABSTRACT

A method for feeding a cellulosic fibrous material to a high pressure processing vessel including: pressurizing a low pressure flow of the fibrous material in a high pressure transfer device; discharging a high pressure flow of the fibrous material from the transfer device to a conduit in fluid communication with the processing vessel; discharging a low pressure flow of fluid and fibrous material from the transfer device; downstream of the transfer device, pressurizing the discharged low pressure flow; merging the pressurized low pressure discharge flow with the discharged high pressure flow, and transferring the merged flow to the processing vessel.

16 Claims, 2 Drawing Sheets

METHOD AND SYSTEM FOR FEEDING CELLULOSE CHIPS TO A HIGH PRESSURE CONTINUOUS COOKING SYSTEM

RELATED APPLICATION

This application claims the benefit, under 35 U.S.C. §119 (e), of U.S. Provisional Application Ser. No. 60/581,382, filed Jun. 22, 2004, the entirety of which is incorporated by reference.

BACKGROUND OF THE INVENTION

This invention relates to a method and system for feeding comminuted cellulosic fibrous material ("chips") to a treatment vessel, such as a continuous digester.

The reaction of pulping chemicals with comminuted cellulosic fibrous material to produce a chemical pulp requires temperatures ranging between 140-180 degree Celsius (C.). Since the aqueous chemicals used to treat the material boil at such temperatures, commercial chemical pulping is typically performed in a pressure-resistant vessel, e.g., a continuous digester, under pressures of at least about 10 bars gauge (approximately 150 psi gauge). To maintain this pressure, especially when performing a continuous pulping process, a high pressure feeder (HPF) increases the pressure of the chip slurry entering the vessel, e.g., a digester, to a pressure level at or above the pressure in the vessel to ensure that the pressure is not lost when introducing material to the pressure vessel.

The present invention relates to the transfer system for feeding chips to a high pressure continuous digester and/or to other high pressure chip processing systems. High pressure chip processing systems typically include a HPF, such as is shown in U.S. Pat. No. 6,669,410. The HPF receives a low-pressure slurry of comminuted cellulosic fibrous material ("chip slurry") and outputs a high-pressure chip slurry. The high pressure slurry is suitable for introduction into a continuous digester, chip steaming vessel and other high pressure chip processing systems.

Typically, high pressure feeders contain a pocketed rotor which acts as a means for transferring a slurry of material from a low pressure to a high pressure while also acting as a valve for preventing loss of pressure. The rotor has a chamber for transferring low pressure slurry to a high pressure stream. An HPF generally has a stationary housing with a low pressure inlet port at its top (12:00 position), low pressure outlet port at its bottom (6:00 position), a high pressure inlet port at a first side (9:00 position) and an high pressure outlet port at an opposite side (3:00 position). A rotor in the feeder housing alternately opens the pair of low pressure inlet and outlet ports and then opens the pair of high pressure inlet and outlet ports. The low pressure ports are not open while the high pressure ports are open and vice versa. When the low pressure inlet and outlet ports are opened, a new volume of chip slurry enters the rotor chamber and some liquid is purged through the outlet. When the rotor opens the high pressure inlet and outlet, high pressure liquid enters and flushes the chip slurry in the rotor chamber through the high pressure outlet into a high pressure conduit.

The top port (12:00) of the feeder housing of the HPF is the low-pressure inlet port into which a slurry of chips and liquid is introduced to the feeder. The top port has historically been the low pressure chip slurry input. However, due to the pump-feeding which characterizes the LO-LEVEL™ Feed System marketed by Andritz Inc. of Glens Falls, N.Y., the pressurized slurry flow from the slurry pump may be introduced to a low-pressure inlet of the HPF which is oriented wherever necessitated by the installation. The pump-fed slurry can be introduced to a port located physically on top, on either side, on the bottom of the HPF, or even to a port oriented at an oblique angle, that is, at any angle of orientation desired.

As the low-pressure slurry is introduced to the low-pressure inlet of the HPF, one or more of the through-going pockets of the rotating rotor receive the slurry. The low-pressure outlet of the HPF is located opposite the low-pressure inlet. As the slurry is introduced to the low-pressure inlet and the first end of one of the through-going pockets, the slurry flows into the rotor pocket and toward a second and opposite end of the pocket, in this case, toward the lower end of the pocket, and toward the low-pressure outlet. The low-pressure outlet port of the HPF is typically provided with a screen element, for example, a cast horizontal bar type screen element (see for example the screen element in U.S. Pat. No. 5,443,162). This screen element retains the chips in the slurry within the rotor of the feeder and allows some of the liquid in the slurry to pass out of the second end of the pocket and through the screen. The liquid discharged from the low-pressure outlet has in the past been recirculated back into the chip feed system to a location upstream of the HPF in the flow of the chip slurry. A difficulty with the screen for the low pressure outlet is that some chips pass through the screen. These chips are then unavailable for further processing in the digester.

The chips that are introduced to the rotor pocket of the HPF, including those chips retained by the screen element, are transported by the rotation of the rotor. After a typical one-quarter revolution of the rotor, the first end of the pocket that was once in communication with the low-pressure inlet is in communication with the HPF high pressure outlet. The high-pressure outlet typically communicates with the inlet of a digester, either a continuous or batch digester, via one or more conduits. At the same time, the rotation of the rotor also places the second end of the through-going pocket, which was just in communication with the low-pressure outlet, in communication with the high-pressure inlet. The high pressure inlet typically receives a flow of high-pressure liquid from a high-pressure hydraulic pump. The pressure of this liquid typically ranges from about 5 to 15 bar gauge, and is typically about 7-10 bar gauge. This high-pressure liquid displaces the slurry of chips and liquid from the through-going pocket and out of the high-pressure outlet and ultimately to the inlet of the digester.

As the rotor continues to rotate, the second end of the pocket which received the high-pressure fluid then is placed in communication with the low-pressure inlet and receives another supply of slurry from the conduit connected to the low-pressure inlet. Similarly, the first end of the pocket is rotated into communication with the low-pressure outlet of the housing, having the screen element. The process described above then repeats itself such that during one complete revolution of the rotor each through-going pocket receives and discharges two charges of chips and liquid. The rotor typically contains at least two, typically four, through-going pockets such that the rotor is repeatedly receiving slurry from the low-pressure inlet and discharging slurry out the high-pressure outlet. The ends of the these pockets act as both an inlet for slurry and an outlet depending upon the orientation of the rotor.

A difficulty has arisen in certain HPFs operating at relatively high rotor speeds. The difficulty is that excessive amounts of chips tend to accumulate on and pass through the screen in the HPF housing at the low-pressure outlet (6:00 position). The chips in the low pressure discharge conduit are lost to the chip processing process and can clog the liquor processing equipment receiving the low pressure discharge of the HPF.

SUMMARY OF THE INVENTION

A method is disclosed for feeding a cellulosic fibrous material to a high pressure processing vessel comprising: pressurizing a low pressure flow of the fibrous material in a high pressure transfer device; discharging a high pressure flow of the fibrous material from the transfer device to a conduit in fluid communication with the processing vessel; discharging a low pressure flow of fluid and fibrous material from the transfer device; downstream of the transfer device, pressurizing the discharged low pressure flow; and merging the pressurized low pressure discharge flow with the discharged high pressure flow In a second embodiment, a method is disclosed for feeding a cellulosic fibrous material to a high pressure processing vessel comprising: pressurizing a low pressure flow of the fibrous material in a high pressure transfer device; discharging a high pressure flow of the fibrous material from the transfer device to a conduit in fluid communication with the processing vessel; extracting a liquor from the slurry of the fibrous material in the processing vessel; introducing a portion of the extracted liquor into a high pressure inlet of the high pressure transfer device, and introducing a second portion of the extracted liquor into the low pressure flow of fibrous material upstream of the transfer device.

Also disclosed is an apparatus for feeding a cellulosic fibrous material to a high pressure processing vessel, said apparatus comprising: a high pressure transfer device receiving a low pressure flow of the fibrous material; a first high pressure conduit connected to a high pressure output of the transfer device to receive a high pressure flow of the fibrous material; a low pressure outlet conduit connected to a low pressure outlet of the transfer device; at least one pump to pressurize a flow in the low pressure outlet conduit and introducing the pressurized flow into a second high pressure conduit; a third high pressure conduit receiving the high pressure flow from the first high pressure conduit and the pressurized flow from the second high pressure conduit, wherein said third high pressure conduit transfers high pressure flow to the processing vessel.

DETAILED DESCRIPTION OF THE INVENTION

Figure 1:
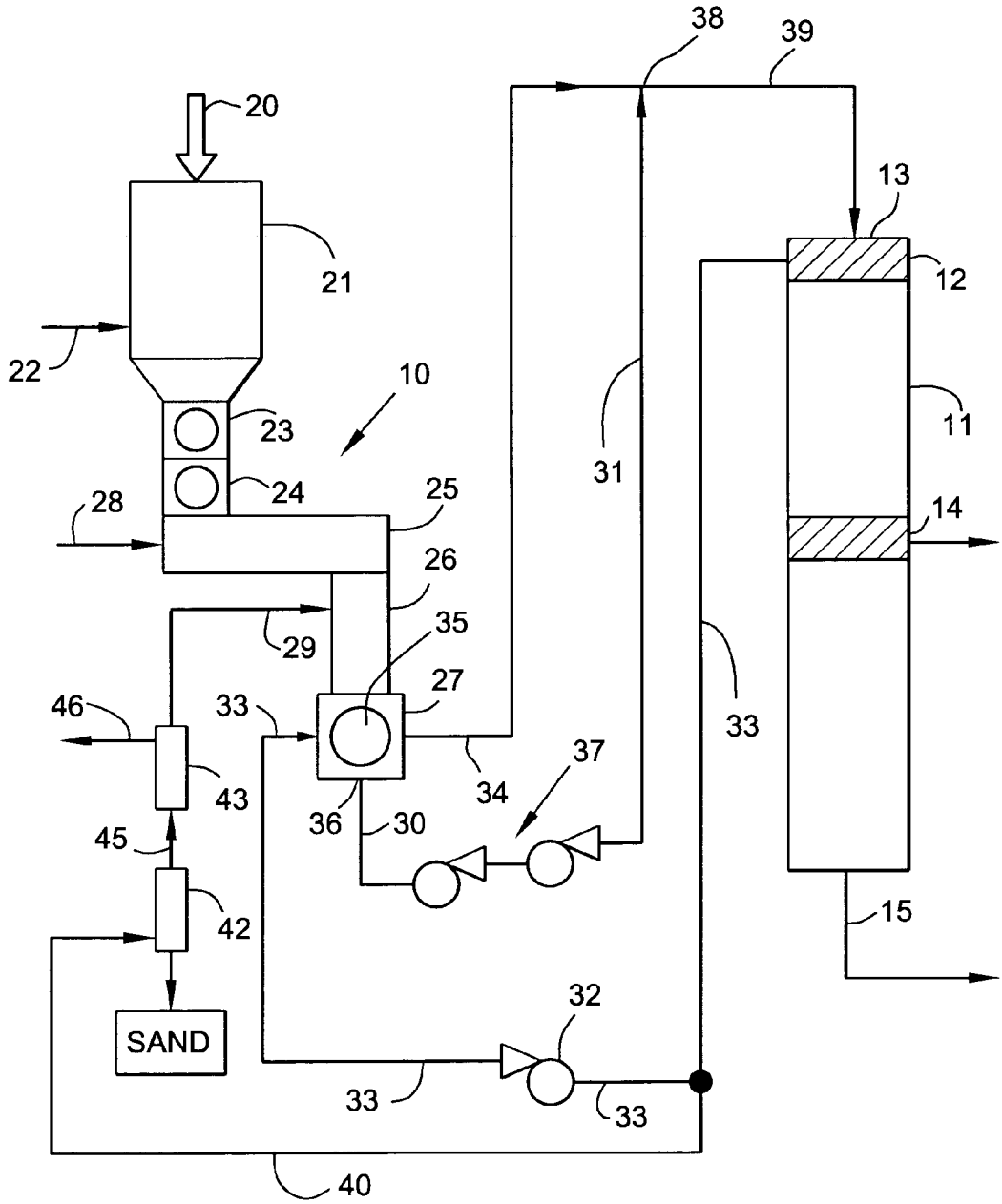
FIG. 1 is a schematic diagram of a system for feeding a slurry of comminuted cellulosic fibrous material to a continuous digester or other high pressure vessel.
Figure 2:
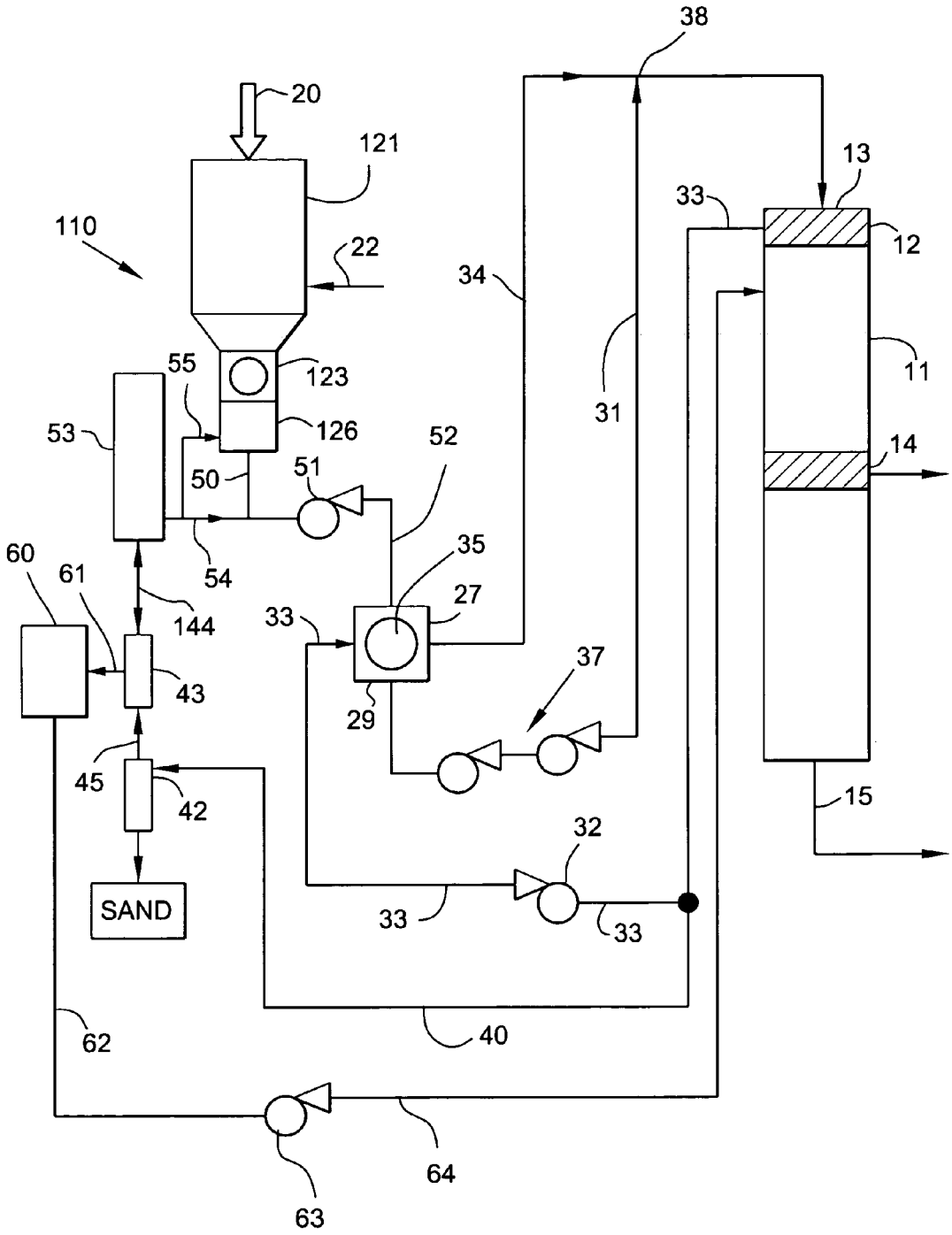
FIG. 2 is a schematic diagram of a system for feeding a slurry of comminuted cellulosic fibrous material to a continuous digester or other high pressure vessel having a second embodiment of a chip feed system.

Though the systems shown and described in FIGS. 1 and 2 are continuous digester systems, it is understood that the method and system of the present invention can also be used to feed one or more batch digesters, an impregnation vessel connected to a continuous digester, or other high pressure processing system. The continuous digesters may be used for kraft pulping, sulfite pulping, soda pulping or equivalent processes.

FIG. 1 illustrates an exemplary chip feed system 10 for feeding a slurry of comminuted cellulosic fibrous material, for example, softwood chips, to the top of a continuous digester 11. The digester 11 typically includes a top separator having a liquor removal screen 12 near the inlet of the digester 13 for removing excess liquor from the slurry and returning it to feed system 10. The digester 11 may also includes at least one liquor removal screen 14 for removing spent cooking liquor during or after the pulping process.

The digester 11 also typically includes one or more additional liquor removal screens (not shown) which may be associated with cooking liquor circulation, digester cooking circulation or digester circulation having a liquor removal conduit and a dilution liquor addition conduit. Cooking liquor, for example, kraft white, black, or green liquor, may be added to these circulations. The digester 11 also includes an outlet 15 for discharging the chemical pulp produced which may be passed on to further treatment such as washing or bleaching.

The chip feed system 10 receives comminuted cellulosic fibrous material 20 introduced into a chip bin 21. Typically, the material 20 is softwood or hardwood chips but any form of comminuted cellulosic fibrous material, such as sawdust, grasses, straw, bagasse, kenaf, or other forms of agricultural waste or a combination thereof, may be used. Though the term "chips" is used in the following discussion to refer to the comminuted cellulosic fibrous material, it is to be understood that the term is not limited to wood chips but refers to any form of the comminuted cellulosic fibrous materials listed above, or the like.

The chip bin 21 may be a conventional bin with vibratory discharge or a DIAMONDBACK™ steaming vessel, as described in U.S. Pat. No. 5,500,083 and sold by Andritz Inc. The bin 21 may include an airlock device at its inlet and a means for monitoring and controlling the level of chips in the bin and a vent with an appropriate mechanism for controlling the pressure within the bin. Steam, either fresh or steam produced from the evaporation of waste liquor (i.e., flashed steam), is typically added to bin 21 via one or more conduits 22.

The bin 21 typically discharges to a metering device 23, such as a screw-type metering device. The metering device 23 discharges to a pressure isolation device 24, such as a low-pressure feeder. The pressure isolation device 24 isolates a pressurized horizontal treatment vessel 25 from the essentially atmospheric pressure that exists in the chip feed system that is upstream of the isolation device 24.

The treatment vessel 25 is used to treat the chip material with pressurized steam, for example steam at approximately 10-20 psig. The vessel 25 may include a screw-type conveyor. Clean or flashed steam may be added to the vessel 25 via one or more conduits 28.

After treatment in vessel 25, the chip slurry is transferred to a high-pressure transfer device 27, such as a High-Pressure Feeder (HPF) sold by Andritz Inc., of Glens Falls, N.Y. Typically, the steamed material is transferred to the feeder 27 by means of a conduit or chute 26, such as a chip chute. Heated cooking liquor, for example, a combination of spent kraft black liquor and white liquor, is typically added to the chute 26 via a conduit 29 so that a slurry of material and liquor is produced in chute 26. The pressurized treatment vessel 25 and the pressure isolation device 24 may be replaced by a steaming vessel such as is disclosed in U.S. Pat. No. 5,000,083, and sold by Andritz as a DIAMONDBACK™ steam vessel.

The High-Pressure Feeder (HPF) 27 includes a rotor housing comprising a low pressure inlet (at a 12:00 position) connected to the chip chute 26, and a low pressure outlet (opposite to the low pressure inlet and at a 6:00 position) connected to a conduit 30. The HPF housing also includes a high-pressure inlet (at a 9:00 position) connected to conduit 33, and a high-pressure outlet (opposite to the high pressure inlet and at a 3:00 position) connected to a conduit 34.

The HPF, and particularly its pocketed rotor 35, may be driven by a variable-speed electric motor and speed reducer (not shown). The low pressure inlet accepts the heated slurry of chips from chute 26 into a pocket of the rotor 35. A screen 36 in the HPF housing at the low-pressure outlet, retains the chips in the rotor pocket but allows liquor to pass through the rotor to be removed via conduit 30.

As the rotor 35 turns the chips that are retained within the rotor pocket are exposed to high pressure liquid entering at the 9:00 high-pressure inlet via conduit 33. The high-pressure liquor flowing into the rotor pocket flushes the chips out of the feeder, through the 3:00 high pressure outlet and into conduit 34. The high-pressure chip slurry flows through conduit 34 and to the top of digester 11.

Upon reaching the inlet of digester 11 some of the excess liquor used to slurry the chips in conduit 34 is removed from the slurry via screen 12. The excess liquor removed via screen 12 is returned to the inlet of pump 32 via conduit 33. The liquor in conduit 33, to which fresh cooking liquor may be added, is pressurized in pump 32 and passed in conduit 33 for use as high pressure liquid to flush chips through the feeder 27.

Low-pressure liquor (and the chips that pass through the screen 36) discharged from the low-pressure outlet (6:00 position) from the feeder 27 flow into the conduit 30. The flow of liquor and chip slurry in conduit 30 is pressurized by pump(s) 37, which is at least one pump and preferably is a serial arrangement of one to four screw impeller pumps. These pump(s) 37 increase the liquor-chip slurry from conduit 30 so that the slurry in conduit 31 is at the same high pressure as the chip slurry conduit 34.

The pressurized chip slurry flow in conduit 31 is combined with the pressurized flow in conduit 34 at a conduit junction 38. The high pressure flows of slurries in conduits 31 and 34 merge into conduit 39 between the conduit junction 38 and the top separator 12 of the digester vessel 11. The chip slurry flow in conduit 31 may have a substantially greater ratio of liquor to chips than the liquor to chip ratio in conduit 34. Accordingly, adding the high liquor content flow from conduit 31 may increase the ratio of liquor to chips in conduit 39.

The volume of flow through conduits 30, 31 may be relatively small compared to the volume in conduit 34. By merging the chip slurry from the low pressure discharge (conduits 30, 31) with the chip slurry from the high-pressure discharge (conduit 34) the chips in conduit 30 are directed to the digester. Chips in the low pressure discharge flow (conduit 30) that would otherwise clog conventional liquor processing systems are introduced to the digester.

The pump(s) 37 may each be a screw centrifugal impeller slurry pumps, or other pressurizing and transferring devices, such as a piston-type solids pump or a high-pressure eductor. Preferably, multiple pressurizing and slurrying pumps 37, e.g., up to four, are used to transfer the slurry through conduits 30, 31 and pressurize the low pressure discharge flow. The pumps 37 may be a screw centrifugal impeller pump such as sold by Hidrostal Ltd. of Newbury England and/or Wemco® pumps supplied by Weir Specialty pumps of Salt Lake City, Utah.

An optional conduit 40 directs a portion of the liquor from conduit 33 (which has liquor from the top separator of the digester) to the chip feed system, such as to chip chute 26, chip bin 21 or treatment vessel 25. A valve (not shown) may be used to control the portion of the flow in conduit 33 that is directed to conduit 40. The valve controlling the flow of conduit 40 is preferably in conduit 29, but may be anywhere in the loop defined by conduits 33, 40, 45 and 29. A sand separator 42 and an in-line drainer 43 may be included and between conduit 40 and conduit 29. The sand separator 42 may be a cyclone-type separator for removing sand and debris from the liquor. The in-line drainer 43 may be a static screening device which removes excess liquor from conduit 45 and passes it to conduit 46 which may lead to a level tank (FIG. 2). The liquor not removed by the in-line drainer passes through conduit 29 and is reintroduced into the chip feed system.

FIG. 2 illustrates another chip feed system 110 for feeding chips to a digester. This system 110 uses processes and equipment described in U.S. Pat. Nos. 5,476,572, 5,622,598 and 5,635,025. This equipment and the processes they are used to effect are collectively marketed under the trademark Lo-Level™ by Andritz Inc. The components in FIG. 2 which are identical to those that appear in FIG. 1 are identified by the same reference numbers. Those components which are similar or which perform similar functions to those that appear in FIG. 1 have their reference numbers that appear in FIG. 1 prefaced by the numeral "1".

Similar to the chip feed system 110 of FIG. 1, chips 20 are introduced to steaming vessel 121 where they are exposed to steam introduced via conduit 22. The vessel 121 discharges to metering device 123, and to a conduit 126, which is preferably a Chip Tube as sold by Andritz Inc. Cooking liquor is typically introduced to tube 126 via conduit 55, similar to conduit 29 of FIG. 1. Since the vessel 121 is preferably a DIAMONDBACK™ steaming vessel as described in U.S. Pat. No. 5,000,083, no pressure isolation device, 24 in FIG. 1, or pressurized steaming vessel 25 in FIG. 1, may be needed. As disclosed in U.S. Pat. No. 5,476,572, instead of discharging the slurry of chips and liquor directly to HPF feeder 27, a high-pressure slurry pump 51 fed by conduit 50 is used to transport the chips to the HPF feeder 27 via conduit 52.

The pump 51 is preferably a screw centrifugal impeller pump or other pump of the same type as pumps 37. The chips that are passed via pump 51 are transported to digester 11 by feeder 27 in a manner similar to what was shown and described with respect to FIG. 1.

As with the embodiment shown in FIG. 1, a portion of the liquor extracted from the digester 11 and that flows into conduit 33 may be optionally diverted into conduit 40. The liquor in conduit 40 passes through a sand separator 42, conduit 45, an in-line drainer 43, and conduit 144 to a liquor level tank 53.

The level tank 53 ensures a sufficient supply of liquor to the inlet of the pump 51, via conduit 54. This tank 53 may also supply liquor to chip tube 126 via conduit 55. This level tank 53 also allows the operator to vary the liquor level in the chip feed system such that, if desired, the liquor level may be elevated to the metering device 123 or even to the bin 121.

Excess liquor removed by the in-line drain 43 may optionally flow into a second level tank 60 via conduit 61 connected to the in-line drain. Liquor from the tank 60 may flow to the digester 11 via conduit 62, pump 63 and conduit 64.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for feeding a cellulosic fibrous material to a high pressure processing vessel comprising:

a. pressurizing a low pressure flow of the fibrous material in a transfer device;

b. discharging a high pressure flow of the fibrous material from the transfer device to a conduit in fluid communication with the processing vessel;

c. discharging a low pressure flow from the transfer device, wherein the discharged low pressure flow includes an entirety of low pressure flow discharged from the transfer device;

d. downstream of the transfer device, pressurizing the discharged low pressure flow, and e. merging the pressurized discharged low pressure flow and the discharged high pressure flow, wherein the merging begins in a flow conduit between a high pressure discharge of the transfer device and a high pressure inlet to the high pressure processing vessel.

2. A method as in claim 1 wherein the high pressure processing vessel is a continuous digester.

3. A method as in claim 1 further comprises pressuring the discharged low pressure flow with a plurality of slurry pumps.

4. A method as in claim 3 wherein the slurry pumps are each a screw centrifugal impeller pump.

5. A method as in claim 1 wherein the merged pressurized discharged low pressure flow and the discharged high pressure flow enters the processing vessel which includes an impregnation vessel.

6. A method as in claim 1 wherein the transfer device is a high pressure feeder.

7. A method as in claim 1 wherein the discharged low pressure flow is pressurized to a pressure substantially the same as a pressure of the discharged high pressure flow.

8. A method as in claim 1 wherein the discharged low pressure flow further comprises fibrous material.

9. A method as in claim 8 wherein the fibrous material in the discharged low pressure flow is merged with the discharged high pressure flow and flows to the processing vessel.

10. A method for feeding a cellulosic fibrous material to a high pressure processing vessel comprising:

a. pressurizing a low pressure flow of the fibrous material in a transfer device;

b. discharging a high pressure flow of the fibrous material from the transfer device to a high pressure conduit in fluid communication with the processing vessel;

c. extracting a liquor from a slurry of the fibrous material and a liquor in the processing vessel, wherein the extracted liquor is discharged from the processing vessel into a flow conduit coupled to the vessel;

d. introducing a first portion of the extracted liquor to a high pressure inlet of the transfer device, and e. introducing a second portion of the extracted liquor to the low pressure flow of fibrous material upstream of the transfer device, wherein the second portion is separated from the first portion at the flow conduit extending from the vessel and extending to the high pressure inlet of the transfer device.

11. A method as in claim 10 further comprising pressurizing the extracted liquor with a pump upstream of the transfer device and downstream of a separation of the first and second portions of the extracted liquor flows.

12. A method as in claim 10 further comprising removing sand from the second portion of extracted liquor before introducing the second portion to the low pressure flow.

13. A method as in claim 10 further comprising introducing the second portion of extracted liquor to a level tank and directing liquor from the level tank to the low pressure flow of fibrous material upstream of the transfer device.

14. A method as in claim 10 further comprising introducing a return portion of the second portion of extracted liquor to the high pressure processing vessel.

15. A method as in claim 14 further comprising a level tank to receive the return portion of the second portion and transferring the return portion from the level tank to the vessel.

16. A method as in claim 14 further comprising a pump to pressurize the return portion of the second portion flowing to the vessel.

* * * * *